US007695273B2

(12) United States Patent
Dempsey

(10) Patent No.: US 7,695,273 B2
(45) Date of Patent: Apr. 13, 2010

(54) LOCKOUT ALGORITHM FOR A FURNACE INCLUDING A POLLUTANT SENSOR

(75) Inventor: Daniel J. Dempsey, Carmel, IN (US)

(73) Assignee: United Technologies Corporation, Hartford, CT (US)

( * ) Notice: Subject to any disclaimer, the term of this patent is extended or adjusted under 35 U.S.C. 154(b) by 118 days.

(21) Appl. No.: 11/542,877

(22) Filed: Oct. 4, 2006

(65) Prior Publication Data

US 2008/0085483 A1 Apr. 10, 2008

(51) Int. Cl.
*F23N 5/24* (2006.01)

(52) U.S. Cl. ..... 431/22; 431/75; 431/76; 431/77; 431/78

(58) Field of Classification Search ..... 431/18, 431/27, 75, 76, 77, 78, 22
See application file for complete search history.

(56) References Cited

U.S. PATENT DOCUMENTS 2,278,252 A * 3/1942 Eaton ..... 431/27
2,393,599 A * 1/1946 Eaton ..... 431/29
3,906,473 A * 9/1975 Le Vine ..... 340/634
3,909,816 A * 9/1975 Teeters ..... 340/578
4,032,286 A * 6/1977 Kobayashi et al. ..... 431/76
4,153,201 A 5/1979 Berger et al.
4,162,889 A * 7/1979 Shigemura ..... 431/76
4,789,330 A * 12/1988 Ballard et al. ..... 431/75
5,074,780 A * 12/1991 Erdman ..... 431/24
5,239,980 A * 8/1993 Hilt et al. ..... 126/116 A
5,379,752 A * 1/1995 Virgil et al. ..... 126/116 A
5,503,550 A * 4/1996 DePalma ..... 431/125
5,576,739 A * 11/1996 Murphy ..... 340/3.4
5,838,243 A * 11/1998 Gallo ..... 340/632
5,971,067 A 10/1999 Rayburn et al.
6,045,352 A * 4/2000 Nicholson ..... 431/22
6,161,535 A * 12/2000 Dempsey et al. ..... 126/110 R
6,283,115 B1 * 9/2001 Dempsey et al. ..... 126/110 R
6,318,150 B1 * 11/2001 Temple ..... 73/23.31
6,321,744 B1 11/2001 Dempsey et al.
6,390,806 B1 * 5/2002 Dempsey et al. ..... 431/21
6,484,951 B1 * 11/2002 Mueller ..... 237/2 A
6,552,647 B1 * 4/2003 Thiessen et al. ..... 340/3.1
6,572,363 B1 * 6/2003 Virgil et al. ..... 431/6
6,743,091 B2 * 6/2004 Meneely, Jr. ..... 454/343
6,851,948 B2 2/2005 Dempsey et al.
7,581,946 B2 9/2009 Donnelly et al.
2005/0267710 A1 * 12/2005 Heavner et al. ..... 702/183

* cited by examiner

*Primary Examiner*—Kenneth B Rinehart
*Assistant Examiner*—Jorge Pereiro
(74) *Attorney, Agent, or Firm*—Kinney & Lange, P.A.

(57) ABSTRACT

A furnace system responsive to a thermostat includes a pollutant sensor for sensing a pollutant concentration in the furnace system. The pollutant sensor is configured to open when the pollutant concentration reaches a pollutant threshold and close when the pollutant concentration falls below the pollutant threshold. When the thermostat is calling for heat, a furnace controller monitors the pollutant sensor and disables the furnace system for a lockout period if a lockout criterion related to the pollutant sensor is met.

22 Claims, 4 Drawing Sheets

LOCKOUT ALGORITHM FOR A FURNACE INCLUDING A POLLUTANT SENSOR

BACKGROUND OF THE INVENTION

The present invention relates to the field of gas furnaces, and in particular to monitoring pollutant levels in the vent system of a furnace and controlling operation of the furnace based on sensed pollutant levels.

Carbon monoxide (CO) may be produced during the combustion process in a malfunctioning gas heating appliance. If excessive CO is released into the heated space, it can cause health related issues for occupants of the heated space. In some conventional ambient air systems, a CO sensor is disposed within the heated space to sense CO levels, and could be configured to disable the flow of fuel to the furnace upon detection of unsafe levels of CO. However, this type of system will either disable the furnace indefinitely, or will cause it to cycle the furnace back on when CO levels are safe, then off again as CO levels rise. If a trip occurs during cold weather, and the building being heated remains unoccupied for a long period of time or a service person is not readily available, water fixtures and pipes can freeze up and burst, causing significant damage to the structure. In addition, if the furnace cycles on and off indefinitely, the cumulative buildup of CO could lead to extended periods of unsafe levels.

BRIEF SUMMARY OF THE INVENTION

The subject invention is directed to a furnace system that includes a pollutant sensor electrically connected between a thermostat and a power supply for sensing a pollutant concentration in the furnace system. The pollutant sensor disconnects the thermostat from the power supply when the pollutant concentration reaches a pollutant threshold and reconnects the thermostat to the power supply when the pollutant concentration falls below the pollutant threshold. When the thermostat is calling for heat, a furnace controller monitors the pollutant sensor and disables the furnace system for a lockout period if a lockout criterion related to the pollutant sensor is met.

DETAILED DESCRIPTION

Figure 1:
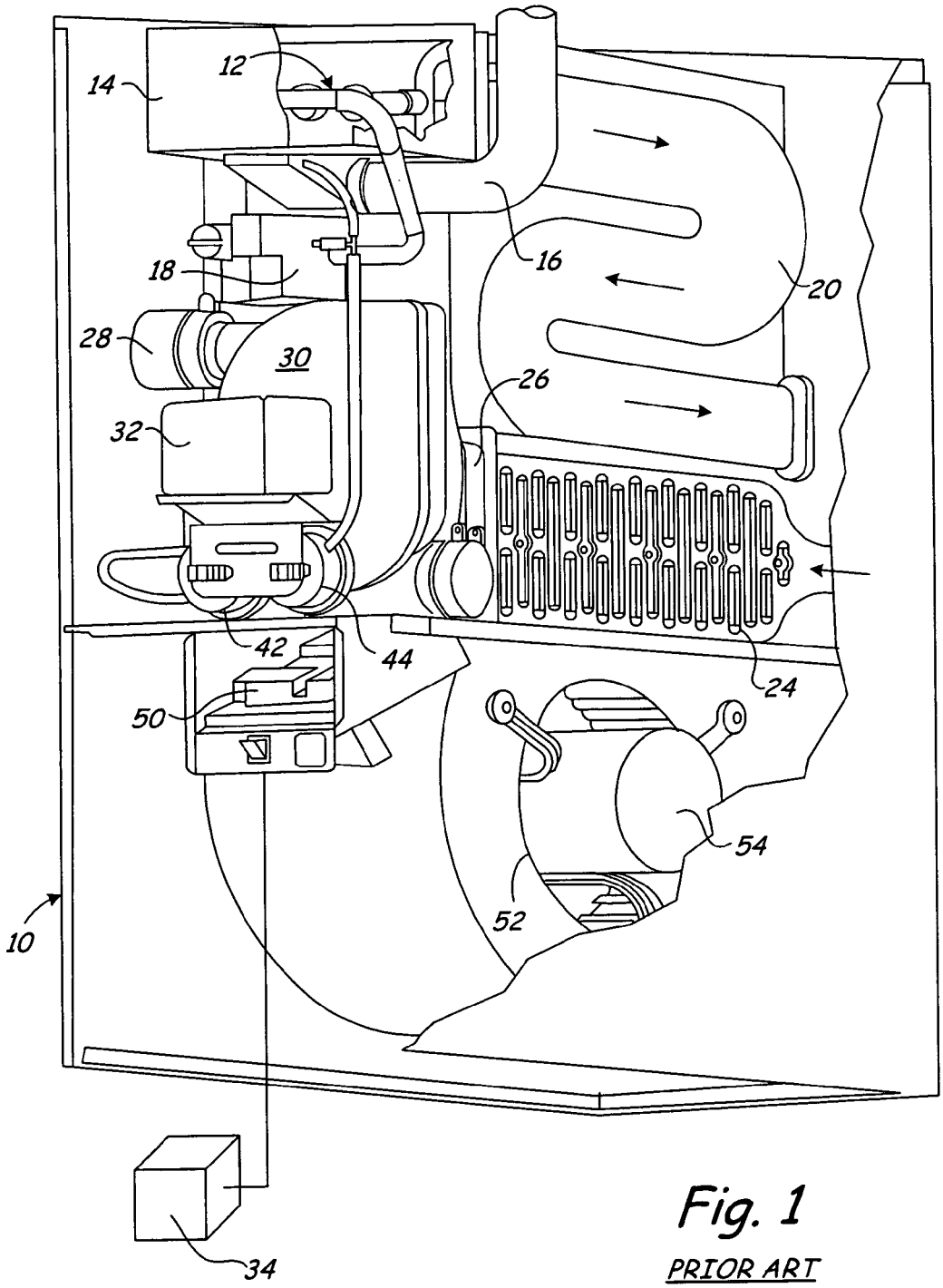
Fig. 1 PRIOR ART
FIG. 1 is a perspective, cutaway view of a furnace.

FIG. 1 is a perspective cutaway view of condensing furnace 10. Furnace 10 includes burner assembly 12, burner box 14, combustion air pipe 16, gas valve 18, primary heat exchanger 20, condensing heat exchanger 24, condensate collector box 26, exhaust vent pipe 28, induced draft blower 30, inducer motor 32, thermostat 34, low pressure switch 42, high pressure switch 44, and furnace control 50.

Burner assembly 12 is located within burner box 14 and is supplied with air via combustion air pipe 16. Fuel gas is supplied to burner assembly 12 through gas valve 18, which may be a solenoid-operated gas valve, and is ignited by an igniter assembly (not shown). The gases produced by combustion within burner box 14 flow through a heat exchanger assembly, which includes primary or non-condensing heat exchanger 20, secondary or condensing heat exchanger 24, and condensate collector box 26. The gases are then vented to the atmosphere by inducer motor 32 through exhaust vent pipe 28. The flow of these gases, herein called combustion gases, is maintained by induced draft blower 30, which is driven by inducer motor 32. Inducer motor 32 is driven in response to speed control signals that are generated by a furnace control circuit located within furnace control 50, in response to the states of low pressure switch 42 and high pressure switch 44, and in response to call-for-heat signals received from thermostat 34 in the space to be heated.

Air from the space to be heated is drawn into furnace 10 by blower 52, which is driven by blower motor 54 in response to speed control signals that are generated by furnace control 50. The discharge air from the blower 52, herein called circulating air, passes over condensing heat exchanger 24 and primary heat exchanger 20 in a counterflow relationship to the flow of combustion air, before being directed to the space to be heated through a duct system (not shown).

If the fuel combustion process in furnace 10 is mid-adjusted or malfunctions, pollutants such as carbon monoxide (CO) could be formed. These pollutants could be introduced into the environment being heated if a vent system fails or is disconnected. Normal furnace design practice is to operate the heat exchanger combustion gases at a pressure less than atmospheric so that any leaks in the heat exchangers leak ambient air into the combustion gas passageways. As an added precaution, in the event that combustion gases are released into the heated space at unacceptable levels, a pollutant sensor may be provided in furnace 10 to sense pollutant levels. In addition, furnace control 50 is operable to maintain acceptable pollutant levels, or to shut the furnace down.

Figure 2:
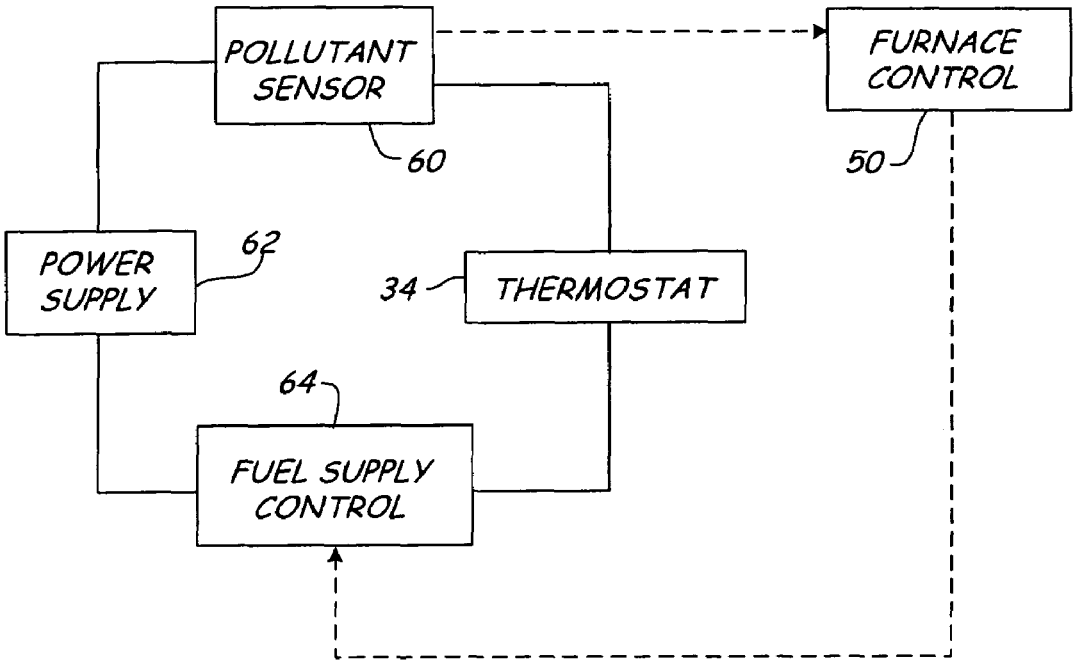
FIG. 2 is a block diagram showing an arrangement of furnace components including a pollutant sensor connected between a thermostat and a power supply.

FIG. 2 is a block diagram of a furnace control system including pollutant sensor 60 connected in electrical series between thermostat 34 and furnace system power supply 62. Pollutant sensor 60 and thermostat 34 control the flow of current to fuel supply control block 64, which includes burner assembly 12, gas valve 1.8, induced draft blower 30, inducer motor 32, low pressure switch 42, and high pressure switch 44 in furnace 10. Pollutant sensor 60 is provided so that it opens the electrical connection between thermostat 34 and power supply 62 if the pollutant level in furnace 10 exceeds a pollutant threshold. In an alternative embodiment, pollutant sensor 60 may be connected between thermostat 34 and fuel supply control block 64 such that fuel supply control block 64 is disabled if the pollutant level in furnace 10 exceeds the pollutant threshold.

The pollutant threshold may be a programmable setpoint in pollutant sensor 60 that is based on acceptable pollutant levels in the combustion gases of furnace 10. Furnace control 50 is connected to receive signals from pollutant sensor 60 related to its status. Current flows to fuel supply control block 64 when thermostat 34 is calling for heat and when the electrical connection that is maintained by pollutant sensor 60 between power supply 62 and thermostat 34 is closed. When pollutant sensor 60 is closed, furnace control 50 manages operation of fuel supply control block 64 for the combustion cycle.

Figure 3:
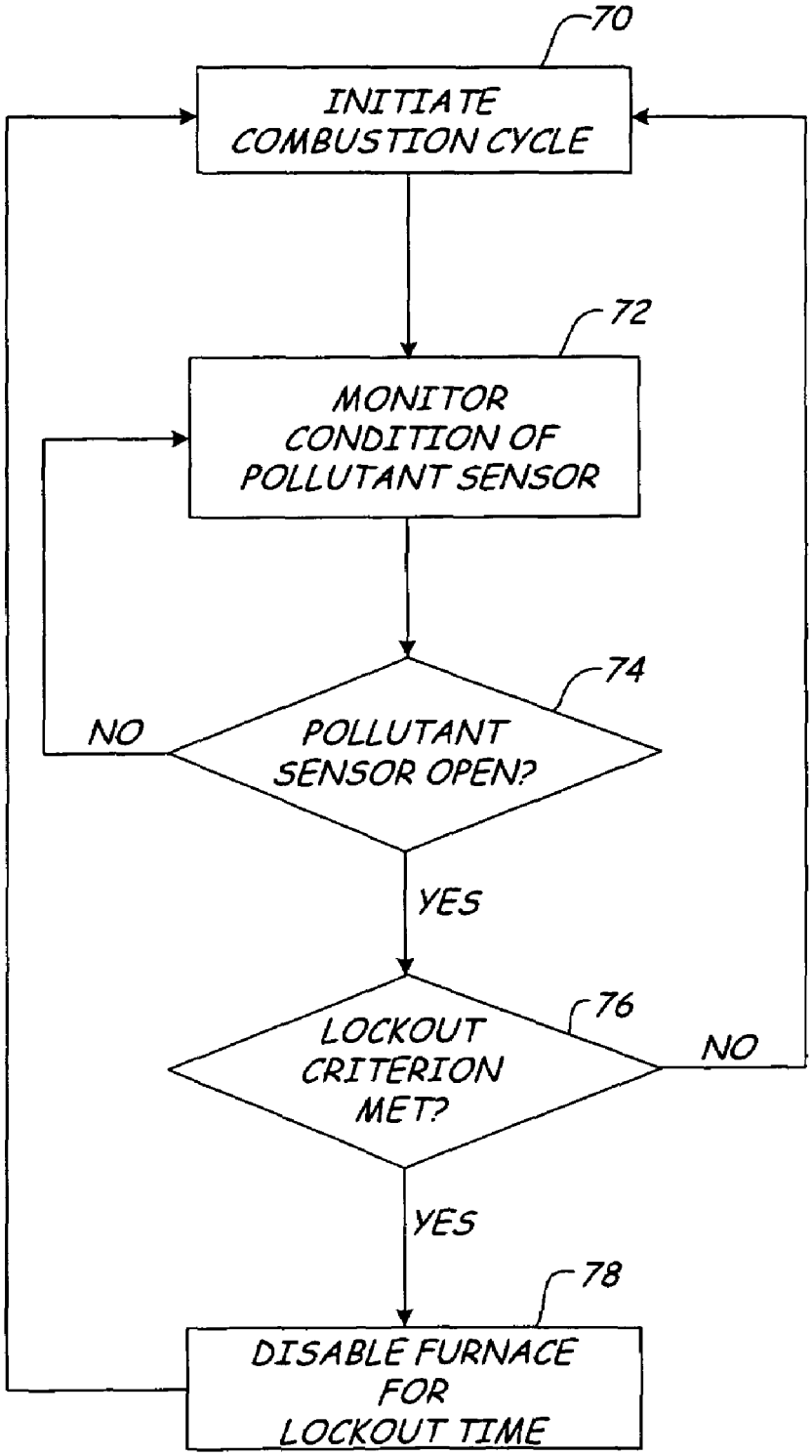
FIG. 3 is a flow chart for controlling operation of the furnace based on sensed pollutant levels.

FIG. 3 is a flow chart for the process of controlling operation of furnace 10 based on the status of pollutant sensor 60. When thermostat 34 calls for heat, furnace control 50 initiates a combustion cycle in furnace 10 by activating inducer motor 32 and energizing gas valve 18 to supply gas to burner assembly 12 for ignition (step 70). Furnace control 50 then monitors the condition of pollutant sensor 60 based on signals received that indicate whether the electrical connection between thermostat 34 and power supply 62 is open or closed (step 72). If pollutant sensor 60 is not open (decision step 74), furnace control 50 continuously monitors the condition of pollutant sensor 60.

If pollutant levels in the combustion gases exceed the programmed pollutant threshold, pollutant sensor 60 opens the electrical connection between power supply 62 and thermostat 34 (decision step 74). When this occurs, a cycle counter in furnace control 50 is increased, and furnace control 50 shuts down furnace 10 (i.e., furnace control 50 de-energizes gas valve 18) to allow pollutant levels to drop below the pollutant threshold. The period of time that pollutant sensor 60 remains open is a function of the sensor's responsiveness to changes in pollutant levels in furnace 10. If pollutant sensor 60 re-closes and thermostat 34 continues to call for heat, furnace control 50 re-initiates the combustion cycle. If pollutant levels in the combustion gases again exceed the programmed threshold level, pollutant sensor 60 again opens, and the cycle counter in furnace control 50 is incremented to track the number of times pollutant sensor 60 opens during a single call for heat.

Furnace control 50 then determines whether a lockout criterion has been met (decision step 76). The lockout criterion is a threshold programmed in furnace control 50 related to the number of times that pollutant sensor 60 opens during a programmed period of time that, when exceeded, causes furnace control 50 to shut down for a lockout period to let the pollutant levels in the heated space to drop to acceptable levels. The lockout criterion may be set based on the number of times pollutant sensor 60 opens, which is related to the value stored in the cycle counter. In various embodiments, this number is in the range of between one and ten. In addition, the lockout criterion may be set based on the number of times pollutant sensor 60 opens within a certain period of time. In various embodiments, the lockout criterion is met if pollutant sensor 60 opens a threshold number of times (e.g., one to ten).within a single heating cycle or within a time in the range of between 1 and 24 hours.

If the lockout criterion has not been met (decision step 76), the combustion cycle is initiated again after pollution sensor 60 closes (step 70). If the lockout criterion is met by pollution sensor 60 opening (decision step 76), furnace control 50 disables furnace 10 for the lockout period (step 78). In various embodiments, the lockout period is between about one hour and about eight hours. After furnace 10 has been disabled for the lockout period of time, furnace control 50 again initiates the combustion cycle to provide heat to the heated environment (step 70). The lockout period is set based on a balance between reducing pollutant levels and assuring that sufficient heat is provided to the heated environment to prevent freezing of pipes and other fixtures.

EXAMPLES

Computer simulations were conducted employing the above algorithm for an 88,000 BTU input furnace having a nominal heating cycle of twelve minutes on, three minutes off, which is a typical furnace operating cycle during periods of very cold weather. The simulated heated environment was a 1,800 square foot one story house with a very low 0.15 air changes per hour (ACH) infiltration rate. It was assumed that all combustion air was drawn from indoors and that all pollutants (in this case, carbon monoxide) produced by the furnace were being released into the living space (e.g., as a result of a completely disconnected or failed vent pipe). It was also assumed that the thermostat was continuously calling for heat. Based on these conditions, the algorithm was tested for different scenarios with several variable input parameters, including the CO concentration threshold of pollutant sensor 60 in parts-per-million (ppm), the time for pollutant sensor 60 to open after the pollutant threshold was reached, the time for pollutant sensor 60 to re-close after the pollutant levels drop below the pollutant threshold, the number of cycles in which pollutant sensor 60 opens and re-closes before lockout occurs, the lockout period, and the steady state average CO concentration in the house. The times for pollutant sensor 60 to open and re-close are functions of the sensitivity and response time of pollutant sensor 60, and thus a variety of sensor open and re-close times were tested to simulate different types of sensors. The number of cycles until lockout and the lockout period are control variables that are programmable in furnace control 50. The results of the simulations are shown in Table 1.

TABLE 1

| Example | CO Concentration (ppm) | Time for Sensor to Open (min) | Time for Sensor to Re-Close (min) | Number of Cycles until Lockout | Lockout Time (min) | Average CO Concentration in House (ppm) |
|---|---|---|---|---|---|---|
| 1 | 400 | 12 | 1 | 1 | 180 | 10.9 |
| 2 | 400 | 12 | 3 | 1 | 180 | 10.9 |
| 3 | 400 | 12 | 6 | 1 | 180 | 10.9 |
| 4 | 400 | 12 | 1 | 3 | 180 | 28.4 |
| 5 | 400 | 6 | 1 | 1 | 180 | 9.6 |
| 6 | 400 | 6 | 1 | 3 | 180 | 26.7 |
| 7 | 400 | 1 | 1 | 1 | 180 | 0.9 |
| 8 | 400 | 1 | 1 | 3 | 180 | 1.5 |
| 9 | 400 | 1 | 1 | 6 | 180 | 2.3 |
| 10 | 1,000 | 12 | 1 | 1 | 180 | 27.5 |
| 11 | 1,000 | 12 | 1 | 3 | 180 | 70.9 |
| 12 | 1,000 | 6 | 1 | 1 | 180 | 23.9 |
| 13 | 1,000 | 6 | 1 | 3 | 180 | 66.5 |
| 14 | 1,000 | 3 | 1 | 1 | 180 | 8.7 |
| 15 | 1,000 | 3 | 1 | 3 | 180 | 23.1 |
| 16 | 1,000 | 1 | 1 | 1 | 180 | 2.2 |
| 17 | 1,000 | 1 | 1 | 3 | 180 | 3.6 |
| 18 | 1,000 | 1 | 1 | 6 | 180 | 5.8 |

Figure 4:
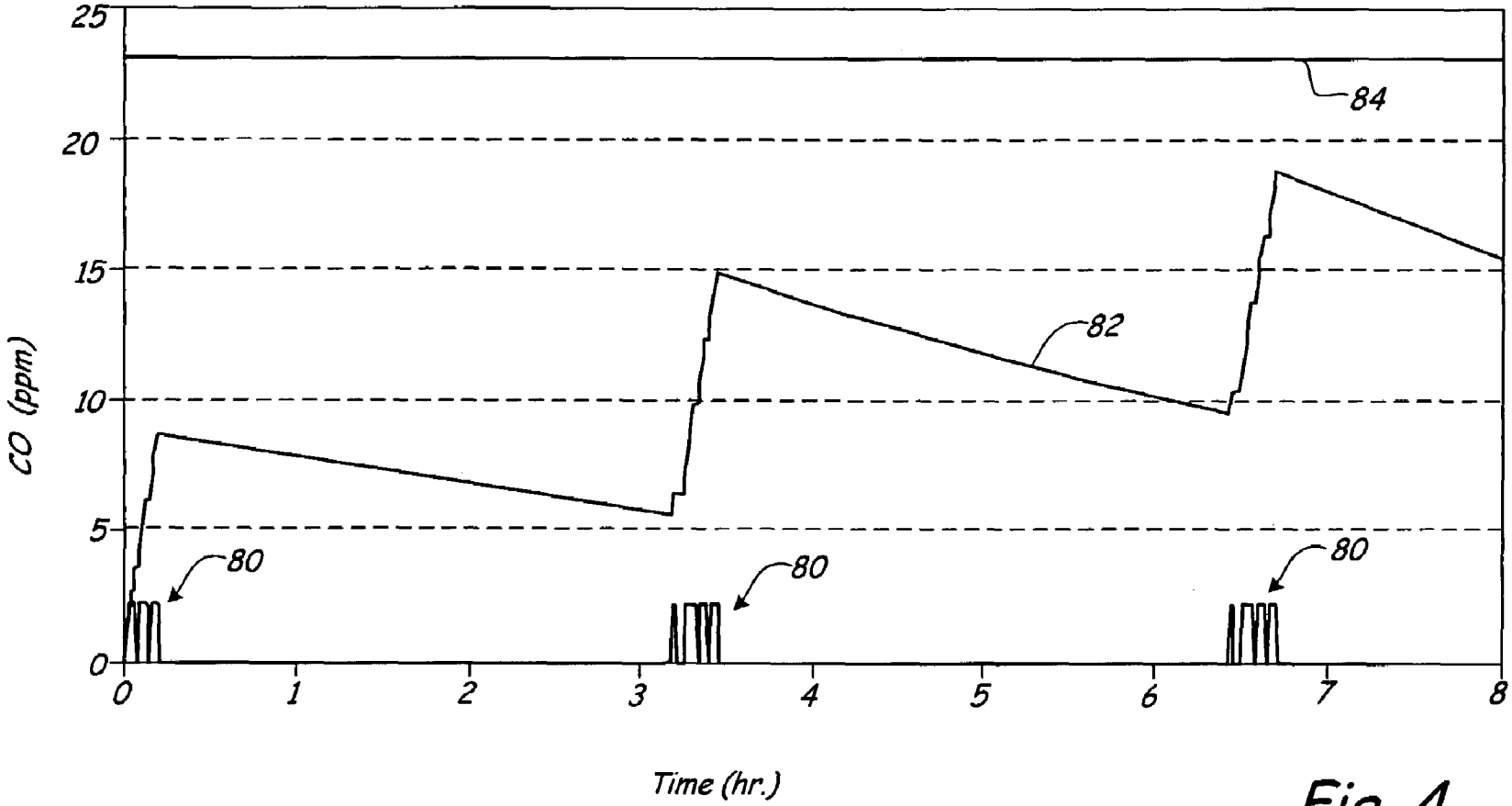
FIG. 4 is a graph of predicted pollutant concentration for a system controlled based on the status of the pollutant sensor.

FIG. 4 is a graph of the predicted pollutant concentration for Example 15 to show the progression of the pollutant concentration in the house during the first eight hours when the furnace is controlled as described above. The combustion gas pollutant threshold for pollutant sensor 60 was set at 1,000 ppm and the pollutant level was allowed to exceed the pollutant threshold for three minutes before pollutant sensor 60 opened. The pollutant sensor 60 then closed after one minute, allowing the combustion cycle to start again. The pollutant sensor 60 was allowed to open and close three times (plots 80) before the furnace was locked out for the lockout period of three hours. The CO concentration in the home (plot 82) generally increased when pollutant sensor 60 cycled between opening and closing, but gradually decreased during the lockout period. If plot 82 were extrapolated out, the CO concentration would eventually level out to a steady state value of 23.1 ppm, which is shown as plot 84 on the graph.

In summary, the subject invention is directed to a furnace system that includes a pollutant sensor for sensing a pollutant concentration in the combustion gases of the furnace system. The pollutant sensor is configured to open when the pollutant concentration reaches a pollutant threshold and close when the pollutant concentration falls below the pollutant threshold. When the thermostat is calling for heat, a furnace controller monitors the pollutant sensor and disables the furnace system for a lockout period if a lockout criterion related to the pollutant sensor is met. When the furnace system is controlled in this manner, heat is provided to the location to prevent freezing of water pipes and fixtures while maintaining pollutants at safe levels.

Although the present invention has been described with reference to examples and preferred embodiments, workers skilled in the art will recognize that changes may be made in form and detail without departing from the spirit and scope of the invention.

The invention claimed is:

1. A method of controlling a furnace, the method comprising:

instituting a combustion cycle;

sensing a pollutant concentration of combustion gases produced by the furnace;

disabling the furnace when the pollutant concentration reaches a pollutant threshold, wherein the pollutant concentration is related to an average pollutant concentration in the home based on one or more of a size of the home, an infiltration rate of pollutant into the home, a time period delay for the pollutant sensor to open after the pollutant concentration reaches the pollutant threshold, a time period delay for the pollutant sensor to close after the pollutant concentration falls below the pollutant threshold, and a size or operation characteristics of the furnace;

enabling the furnace when the pollutant concentration falls below the pollutant threshold;

disabling the furnace for a lockout period if the furnace is disabled a threshold number of times; and reinstituting the combustion cycle after the furnace has been disabled for the lockout period.

2. The method of claim 1, wherein the threshold number of times is in the range of 1 to 10.

3. The method of claim 1, wherein the furnace is disabled for the lockout period when the furnace is disabled the threshold number of times within a threshold period of time.

4. The method of claim 1, wherein the threshold period of time is between about 1 hour and about 24 hours.

5. The method of claim 1, wherein the lockout period is in the range of about 1 hour to about 8 hours.

6. A furnace system responsive to a thermostat, the furnace system comprising:

a pollutant sensor for sensing a pollutant concentration in combustion gases produced by a furnace, wherein the pollutant sensor opens when the pollutant concentration reaches a pollutant threshold and closes when the pollutant concentration falls below the pollutant threshold; and a furnace controller that, when the thermostat is calling for heat, monitors the pollutant sensor and disables the furnace system for a lockout period if a lockout criterion relating the sensed pollutant concentration in combustion gases to an average pollutant concentration in a home is met, wherein relating the sensed pollutant concentration to the average pollutant concentration is based on one or more of a size of the home, an infiltration rate of pollutant into the home, a time period delay for the pollutant sensor to open after the pollutant concentration reaches the pollutant threshold, a time period delay for the pollutant sensor to close after the pollutant concentration falls below the pollutant threshold, and a size or operation characteristics of the furnace.

7. The furnace system of claim 6, wherein the pollutant sensor is electrically connected between the thermostat and at least one of a power supply and a fuel supply controller.

8. The furnace system of claim 6, wherein the lockout criterion is met if the pollutant sensor opens a threshold number of times.

9. The furnace system of claim 8, wherein the threshold number of times is in the range of 1 to 10.

10. The furnace system of claim 6, wherein the lockout criterion is met if the pollutant sensor opens the threshold number of times within a threshold period of time.

11. The furnace system of claim 10, wherein the threshold period of time is between about 1 hour and about 24 hours.

12. The furnace system of claim 10, wherein the threshold period of time is one heating cycle duration.

13. The furnace system of claim 6, wherein the lockout period is in the range of about 1 hour to about 8 hours.

14. A method of controlling a furnace after a call for heat from a thermostat, wherein the furnace includes a pollutant sensor that opens when the pollutant concentration reaches a pollutant threshold and closes when the pollutant concentration falls below the pollutant threshold, the method comprising:

instituting a combustion cycle;

monitoring a condition of the pollutant sensor positioned in pollutant gases produced by the furnace;

disabling the furnace for a lockout period if a lockout criterion relating the monitored pollutant concentration in combustion gases to an average pollutant concentration in a home is met, wherein relating the sensed pollutant concentration to the average pollutant concentration is based on one or more of a size of the home, an infiltration rate of pollutant into the home, a time period delay for the pollutant sensor to open after the pollutant concentration reaches the pollutant threshold, a time period delay for the pollutant sensor to close after the pollutant concentration falls below the pollutant threshold, and a size or operation characteristics of the furnace; and reinstituting the combustion cycle after the furnace has been disabled for the lockout period.

15. The method of claim 14, wherein monitoring a condition of the pollutant sensor comprises determining whether the pollutant sensor has opened.

16. The method of claim 14, wherein the pollutant sensor is electrically connected between the thermostat and at least one of a furnace power supply and a furnace fuel supply controller.

17. The method of claim 14, wherein the lockout criterion is met if the pollutant sensor opens a threshold number of times.

18. The method of claim 17, wherein the threshold number of times is in the range of 1 to 10.

19. The method of claim 14, wherein the lockout criterion is met if the pollutant sensor opens the threshold number of times within a threshold period of time.

20. The method of claim 19, wherein the threshold period of time is between about 1 hour and about 24 hours.

21. The method of claim 19, wherein the threshold period of time is one heating cycle duration.

22. The method of claim 14, wherein the lockout period is in the range of about 1 hour to about 8 hours.

* * * * *